United States Patent [19]

Nakao et al.

[11] Patent Number: 4,559,288

[45] Date of Patent: Dec. 17, 1985

[54] ELECTROPHOTOGRAPHIC PHOTORECEPTOR

[75] Inventors: Sho Nakao; Kenji Kunichika; Chikashi Ohishi; Masato Iwai; Kiyoshi Iwamoto, all of Shizuoka, Japan

[73] Assignee: Fuji Photo Film Co., Ltd., Tokyo, Japan

[21] Appl. No.: 651,738

[22] Filed: Sep. 18, 1984

[30] Foreign Application Priority Data

Sep. 19, 1983 [JP] Japan ..... 58-172832

[51] Int. Cl.[4] ..... G03G 5/14

[52] U.S. Cl. ..... 430/60; 430/65

[58] Field of Search ..... 430/60, 63, 65

[56] References Cited

U.S. PATENT DOCUMENTS

| | | | |
|---|---|---|---|
| 4,416,963 | 11/1983 | Takimoto et al. | 430/63 X |
| 4,456,670 | 6/1984 | Nakayama et al. | 430/63 X |
| 4,500,620 | 2/1985 | Ohishi | 430/60 |

FOREIGN PATENT DOCUMENTS

| | | | |
|---|---|---|---|
| 57-81266 | 5/1982 | Japan | 430/60 |
| 58-152253 | 9/1983 | Japan | 430/60 |
| 2075365 | 11/1981 | United Kingdom | 430/63 |

*Primary Examiner*—Roland E. Martin

*Attorney, Agent, or Firm*—Sughrue, Mion, Zinn, Macpeak & Seas

[57] ABSTRACT

An electrophotographic photoreceptor having on a conductive support an interlayer and a photoconductive photoreceptive layer in that order, with the interlayer containing at least one colloidal substance selected from colloidal silica and colloidal alumina, and an organic solvent soluble resin which is composed of (A) a polymer having an acid value of from 10 to 100 and containing repeating units represented by formula (I) and (II)

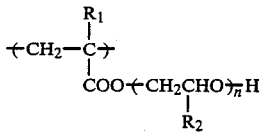

(I)

wherein $R_1$ represents H or $CH_3$; $R_2$ represents H, $—CH_3$, $—C_2H_5$, or a chloromethyl group; and n represents an integer of 1 to 10;

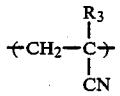

(II)

wherein $R_3$ represents H or $—CH_3$; and (B) at least one polymer selected from a homopolymer and a plural copolymer having a glass transition point (Tg) of from −70° to 20° C., which can be utilized as a lithographic printing material having long press life.

9 Claims, No Drawings

ELECTROPHOTOGRAPHIC PHOTORECEPTOR

FIELD OF THE INVENTION

This invention relates to an electrophotographic photoreceptor using a photoconductive photoreceptive layer, and more particularly, to an electrophotographic photoreceptor in which a specific interlayer is provided between a conductive support and a photoreceptive layer.

BACKGROUND OF THE INVENTION

Electrophotographic photoreceptors of the kind which have an electrophotographic photoreceptive layer containing photoconductive zinc oxide dispersed in a resin binder, and optionally an interlayer, on a conductive support have been predominately employed as a copying material and a lithographic printing material.

The importance of the interlayer in such photoreceptor is described in a large number of literature articles and patents. Specifically, the interlayer has influences on the adhesiveness between a support and a photoreceptive layer, the photoreceptivity, stains in the non-image area, white spots in the image area (which is a phenomenon wherein the toner does not adhere to the image area in spots) and so on. Besides having influences as described above, in order to strongly bond the photoreceptive layer to the support, the interlayer is particularly required when the electrophotographic photoreceptor is employed as a lithographic printing material, because the photoreceptor is exposed to damping water during printing. Though in the graphic art there has recently been a need for electrophotography utilizing lithographic printing materials having such long press life as to provide not less than 10,000 sheets of copies, interlayers which have so far been proposed are not sufficiently satisfactory in adhesion between support and photoreceptive layer, and suffer from the defects that the photoreceptive layer is slightly delaminated during printing, white spots are generated in the image area, and toner adheres to the non-image areas to cause fog, thereby, stains by printing are generated.

SUMMARY OF THE INVENTION

As a result of extensive investigations for a solution of the above-described problems, it has now been found that the above-described problems can be solved by an electrophotographic photoreceptor in which an interlayer and a photoconductive photoreceptive layer are provided on a conductive support in that order, the interlayer comprising at least one colloidal substance selected from colloidal silica and colloidal alumina and an organic solvent-soluble resin which is composed of (A) a polymer having an acid value of from 10 to 100 and containing repeating units represented by formula (I) and (II)

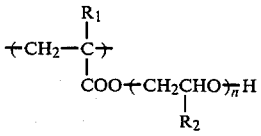

(I)

wherein $R_1$ represents H or $-CH_3$; $R_2$ represents H, $-CH_3$, $-C_2H_5$, or a chloromethyl group; and n represents an integer of 1 to 10;

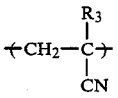

(II)

wherein $R_3$ represents H or $-CH_3$; and (B) at least one polymer selected from a homopolymer and a plural copolymer having a glass transition point (Tg) of from −70° to 20° C.

DETAILED DESCRIPTION OF THE INVENTION

Suitable examples of a conductive support which can be used in this invention include metals, paper which has been so processed as to acquire electric conductivity, electroconductive plastic sheets, plastic sheets on which aluminium or the like is evaporated, paper on which a plastic film rendered electrically conductive is laminated, and so on. Of these materials, paper on which a plastic film rendered conductive is laminated is most suitable for the support. Such paper is prepared by laminating a polyolefin layer containing a conductivity imparting agent on either side or both sides of base paper.

For the above-described polyolefin, polyethylene or polypropylene are suitable. Particularly preferable polyethylene has a density of from 0.92 to 0.96, a mean molecular weight of from 20,000 to 50,000, a softening point of from 110° to 130° C., a tensile strength of from 130 to 300 kg/cm$^2$, and a specific volume resistance of $10^{15}$ Ω.cm or more. On the other hand, particularly preferable polypropylene has a density of from 0.85 to 0.92, a softening point of from 75° to 170° C., a tensile strength of from 280 to 420 kg/cm$^2$, and a specific volume resistance of $10^{15}$ Ω.cm or above. Polyethylene having the above-described characteristics is the most preferred polyolefin.

In the polyolefin laminate layer described above, an electrically conductive substance is incorporated so that the volume resistivity of the support obtained may finally reach $10^{10}$ Ω or less. The expression "volume resistivity" used herein refers to the resistivity measured by arranging a pair of circular electrodes having a radius of 2.5 cm facing each other, with the support between them in a closely contacting condition, and applying a D.C. voltage between the electrodes. Incorporation of an electrically conductive substance enables suppression of change in photographic properties due to variations in the humidity (particularly a decrease in humidity) and thereby, it becomes feasible to produce lithographic printing plates having excellent image quality and long press life. Particularly preferred electrically conductive substances have the volume resistivity of $10^2$ Ω or less and include metal oxides as described in French Pat. No. 2,277,136 and U.S. Pat. No. 3,597,272, especially oxides of metals selected from a group consisting of zinc, magnesium, tin, barium, indium, molybdenum, aluminum, titanium, and silicon, more preferably crystalline oxides, fine grains of complex oxides thereof, or carbon black. Of these substances, conductive carbon black is used to advantage because of low price and high compatibility with polyolefins.

An electrically conductive substance as described above is used in an amount necessary to adjust the volume resistivity of the resulting support to $10^{10}$ Ω or less, and preferably $10^8$ Ω or less. Since the amount used for attaining the foregoing resistivity depends on the kinds of base paper and the polyolefin used, as well as the electrically conductive substance used, the combination must be considered in determining the amount of electrically conductive substance. As a guide, a usable amount is an the range of from 5 to 30 wt% to polyolefin.

The foregoing polyolefins are coated on at least one side of the base paper, and preferably on both sides thereof, using a laminating process. Suitable examples of a laminating process which can be employed herein include those well-known in the art, such as a wet process, a dry process, a hot melt process, an extrusion process and so on. Of these processes, an extrusion process is particularly preferred. The extrusion process comprises melting a polyolefin, forming it into a film, and immediately thereafter pressing the film on the base paper to make the film adhere to the base paper, and then cooling it to form a laminate of the polyolefin on the base paper. Various kinds of apparatuses for effecting the extrusion process are known.

A preferred thickness of a polyolefin layer laminated in the above-described manner is in the range of 5 to 50μ. If the thickness is thinner than 5μ, a water-proofing effect on base paper becomes insufficient, whereas if it is thicker than 50μ, there is no further enhancement of the properties provided and the increase in cost thereof is in vain.

For the purpose of increasing adhesiveness of base paper to the above-described polyolefin laminate layer, it is to be desired that the surface of base paper should be coated in advance with a polyethylene derivative, such as an ethylene-vinyl acetate copolymer, an ethylene-acrylate copolymer, an ethylene-methacrylate copolymer, an ethylene-acrylic acid copolymer, an ethylene-methacrylic acid copolymer, an ethylene-acrylonitrile-acrylic acid terpolymer, an ethylene-acrylonitrile-methacrylic acid terpolymer, etc., or should be subjected in advance to a corona discharge treatment. Alternatively, surface treatments as described in Japanese Patent Applications (OPI) Nos. 24126/74, 36176/77, 121683/77, 2612/78 and 111331/79, and Japanese Patent Publication No. 25337/76 can also be applied to base paper (The term "OPI" herein refers to "published unexamined Japanese Patent Application").

Although the foregoing describes preferred conductive papers which are desirably used in the practice of the present invention, any kinds of conductive paper which have been used in electrophotographic photoreceptive materials can be used as the base paper to be employed in the practice of the present invention. For example, paper impregnated with an ionic conductive substance, an inorganic metallic compound as described in U.S. Pat. No. 3,597,272 and French Pat. No. 2,277,136, or an electrically conductive substance like carbon black; paper containing one of the above-described substances by incorporation thereof upon paper-making; and synthetic paper of the kinds described in Japanese Patent Publication Nos. 4239/77 and 19031/78, and U.S. Pat. No. 4,064,304 can be employed. Preferred examples of ionic conductive substances which can be used include cationic surface active agents such as alkyltrimethylammonium salts, alkyldimethylammonium salts, alkyldimethylbenzylammonium salts and the like, and polyelectrolytes such as polydimethyldiallylammonium chloride, polyvinylbenzyltrimethylammonium chloride and the like. These substances are coated independently or in the form of a mixture on both sides of base paper at a coverage of from 3 to 15 g/m$^2$, and preferable from 5 to 10 g/m$^2$, and dried, to make a conductive base paper.

Suitable examples of an organic solvent-soluble resin which is one of the components of the interlayer to be employed in this invention include those which have so far been frequently used as a resin interlayer, such as vinyl resins (e.g., polyethylene, polybutadiene, polystyrene, styrene-butadiene copolymers, vinyl acetate resins, etc.), condensation copolymers (e.g., polyester, polyamide, polycarbonate, etc.), epoxy resins, urethane resins, homopolymers and copolymers of acrylic acid esters and methacrylic acid, silicone resins, alkyd resins, cellulose resins, polyvinyl alcohol and so on.

Resins which constitute a particularly favorable interlayer in this invention are mixtures of (A) a polymer having an acid value of 10 to 100 and containing repeating units represented by formulae (I) and (II),

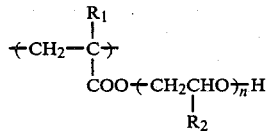

(I)

wherein $R_1$ represents H or —$CH_3$; $R_2$ represents H,—$CH_3$,—$C_2H_5$, or a chloromethyl group; and n represents an integer of 1 to 10;

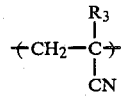

(II)

wherein $R_3$ represents H or —$CH_3$; and (B) polymers having a glass transition point (Tg) ranging from −70° C. to 20° C.

The polymers (A) include, e.g., ternary, quaternary and plural copolymers constituted with a compound represented by the following general formula (III), acrylonitrile or methacrylonitrile, and an α,β-unsaturated carboxylic acid and optionally, other addition polymerizing unsaturated compounds: and copolymers produced by reacting a binary, ternary, or plural copolymer, which is prepared from a compound represented by the following formula (III), acrylonitrile or methacrylonitrile, and optionally other addition polymerizing unsaturated compounds, with a cyclic acid anhydride to convert into an ester:

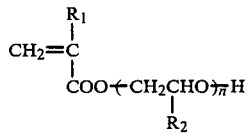

(III)

wherein $R_1$, $R_2$, and n have the same meanings as in formula (I), respectively.

Suitable examples of α,β-unsaturated carboxylic acids which can be used include acrylic acid, methacrylic acid, ethaacrylic acid, maleic anhydride, methylmaleic anhydride, phenylmaleic anhydride, crotonic acid, itaconic acid, vinylbenzoic acid, sorbic acid, cinnamic acid, allysulfonic acid, vinylsulfonic acid, vinylbenzenesulfonic acid, and the like.

Suitable examples of other addition polymerizing unsaturated compounds which are optionally copolymerized include acrylic acid esters, acrylamides, methacrylic acid esters, methacrylamides, allyl compounds, vinyl ethers, vinyl esters, styrenes, crotonic acid esters and other like compounds containing one addition polymerizing unsaturated bond. More specifically, examples include acrylic acid esters, such as alkylacrylates (e.g., methylacrylate, ethylacrylate, propylacrylate, butylacrylate, amylacrylate, ethylhexylacrylate, octylacrylate, t-octylacrylate, chloroethylacrylate, 2,2-dimethylhydroxypropylacrylate, 5-hydroxypentylacrylate, trimethylolpropane monoacrylate, pentaerythritol monoacrylate, glycidylacrylate, benzylacrylate, methoxybenzylacrylate, furfurylacrylate, tetrahydrofurfurylacrylate, etc.), arylacrylates (e.g., phenylacrylate, etc.), etc.: methacrylic acid esters, such as alkylmethacrylates (e.g., methylmethacrylate, ethylmethacrylate, propylmethacrylate, isopropylmethacrylate, amylmethacrylate, hexylmethacrylate, cyclohexylmethacrylate, benzylmethacrylate, chlorobenzylmethacrylate, octylmethacrylate, 4-hydroxybutylmethacrylate, 5-hydroxypentylmethacrylate, 2,2-dimethyl-3-hydroxypropylmethacrylate, trimethylolpropane monomethacrylate, pentaerythritol monomethacrylate, glycidylmethacrylate, furfurylmethacrylate, tetrahydrofurfurylmethacrylate, etc.), arylmethacrylates (e.g., phenylmethacrylate, cresylmethacrylate, naphthylmethacrylate, etc.), etc.; acrylamides, such as acrylamide, N-alkylacrylamides (the alkyl moiety of which is, e.g., methyl group, ethyl group, propyl group, butyl group, t-butyl group, heptyl group, octyl group, cyclohexyl group, hydroxyethyl group, benzyl group, or the like), N-arylacrylamides (the aryl moiety of which is, e.g., phenyl group, tolyl group, nitrophenyl group, naphthyl group, hydroxyphenyl group, or the like), N,N-dialkylacrylamides (the alkyl moieties of which are, e.g., methyl group, ethyl group, butyl group, isobutyl group, ethylhexyl group, cyclohexyl group, etc.), N,N-diarylacrylamides (the aryl moieties of which are, e.g., phenyl group, etc.), N-methyl-N-phenylarylamide, N-hydroxyethyl-N-methylacrylamide, N-2-acetoamidoethyl-N-acetylacrylamide, etc.; methacrylamides, such as methacrylamide, N-alkylmethacrylamides (the alkyl moiety of which is, e.g., methyl group, ethyl group, t-butyl group, ethylhexyl group, hydroxyethyl group, cyclohexyl group, etc.), N-arylmethacrylamides (the aryl moiety of which is, e.g., phenyl group, etc.), N,N-dialkylmethacrylamides (the alkyl moieties of which are, e.g., ethyl group, propyl group, butyl group, etc.), N,N-diarylmethacrylamides (the aryl moities of which are, e.g., phenyl group, etc.), N-hydroxyethyl-N-methylmethacrylamide, N-methyl-N-phenylmethacrylamide, N-ethyl-N-phenylmethacrylamide, etc.; allyl compounds, such as allyl esters (e.g., allyl acetate, allyl caproate, allyl caprylate, allyl laurate, allyl palmitate, allyl stearate, allyl benzoate, allyl acetone-acetate, allyl lactate, etc.), allyloxyethanol, etc.; vinyl ethers, such as alkyl vinyl ethers (e.g., hexyl vinyl ether, octyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropyl vinyl ether, 2-ethylbutyl ether, hydroxyethyl vinyl ether, diethylene glycol vinyl ether, dimethylaminoethyl vinyl ether, diethylaminoethyl vinyl ether, butylaminoethyl vinyl ether, benzyl vinyl ether, tetrahydrofurfuryl vinyl ether, etc.), vinyl aryl ethers (e.g., vinyl phenyl ether, vinyl tolyl ether, vinyl chlorophenyl ether, vinyl-2,4-dichlorophenyl ether, vinyl naphthyl ether, vinyl anthranyl ether, etc.), etc.; vinyl esters, such as vinyl butylate, vinyl isobutylate, vinyl trimethyl-acetate, vinyl diethylacetate, vinyl valerate, vinyl caproate, vinyl chloroacetate, vinyl dichloroacetate, vinyl methoxyacetate, vinyl butoxyacetate, vinyl phenyl-acetate, vinyl acetoacetate, vinyl lactate, vinyl-$\beta$-phenylbutylate, vinyl cyclohexylcarboxylate, vinyl benzoate, vinyl salycilate, vinyl chlorobenzoate, vinyl tetrachlorobenzoate, vinyl naphthoate, etc.; styrenes, such as styrene, alkylstyrenes (e.g., methylstyrene, dimethylstyrene, trimethylstyrene, ethylstyrene, diethylstyrene, isopropylstyrene, butylstyrene, hexylstyrene, chlorohexylstylene, decylstyrene, benzylstyrene, chloromethylstyrene, trifluoromethylstyrene, ethoxymethylstyrene, acetoxymethylstyrene, etc.), alkoxystyrenes (e.g., methoxystyrene, 4-methoxy-3-methylstyrene, dimethoxystyrene, etc.), halogenostyrenes (e.g., chlorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethylstyrene, 4-fluoro-3-trifluoromethyl styrene), etc.; crotonic acid esters, such as alkyl crotonates (e.g., butyl crotonate, hexyl crotonate, glycerine monocrotonate, etc.); dialkyl itaconates, such as dimethyl itaconate, diethyl itaconate, dibutyl itaconate, etc.; dialkyl maleates or fumarates (e.g., dimethyl maleate, dibutyl fumarate, etc.); and so on. In addition, any addition polymerizing unsaturated compounds capable of copolymerizing with the compound represented by the foregoing formula (III) and acrylonitrile or methacrylonitrile may generally be used. However, addition polymerizing unsaturated compounds having such functional groups as to react with the hydroxyl group of $\beta$-hydroxyethyl-(metha)acrylate at room temperature, and polyfunctional addition polymerizing unsaturated compounds having two or more of polymerizing vinyl groups in a molecule are undesirable.

Suitable examples of cyclic acid anhydrides which can be half-esterified with copolymers prepared from the compounds represented by formula (III), acrylonitrile or methacrylonitrile and optionally, other addition polymerizing unsaturated compounds, include phthalic anhydride, tetrahydrophthalic anhydride, hexahydrophthalic anhydride, 3,6-endomethylene-$\Delta^4$-tetrahydrophthalic anhydride, 3,6-endo-oxy-$\Delta^4$-tetrahydrophthalic anhydride, tetrachlorophthalic anhydride, maleic anhydride, chloromaleic anhydride, succinic anhydride, n-dodecylsuccinic anhydride, and the like.

A suitable acid value of the polymer described above ranges from 10 to 100, particularly from 15 to 40. If the polymer has an acid value of more than 100, it tends to generate white spots in the image area upon toner development (a phenomenon wherein the toner does not adhere to the image area in spots), whereas if it has an acid value of less than 10, adhesion between the support and the resulting interlayer tends to be decreased.

A preferred fraction of acrylonitrile or methacrylonitrile contained as a constitutional unit in the polymer (A) to be employed in this invention, which is the constitutional repeating unit represented by formula (II), is in the range of from 5 to 60 wt%, and more preferably from 10 to 40 wt% based on the total weight of the polymer (A).

On the other hand, a preferred fraction of the constitutional repeating unit represented by formula (I) is in the range of from 30 to 80 wt%, and more preferably from 40 to 60 wt% based on the total weight of the polymer (A).

If fractions of these constitutional units are outside of the above-described ranges respectively, the properties with respect to one or more of the evaluation items, including the adhesiveness to a support, white spots in the image area, stain in the non-image area (i.e., toner adhesion to the non-image area), the amount of toner fixed on the image area, and so on, is deteriorated.

The polymer (B), which is also a component of the organic solvent-soluble resin constituting the interlayer to be employed in this invention, includes homopolymers and/or plural copolymers having a glass transition point (Tg) of from −70° C. to 20° C., and preferably from −20° C. to 20° C. A good result is obtained when the polymer (B) is used in an amount of from 5 to 30 parts by weight per 100 parts by weight of the polymer (A). If the polymer (B) is used in an amount of less than 5 parts by weight, white spots are apt to be generated, whereas if more than 30 parts by weight are contained, adhesiveness to the photoreceptive layer tends to be deteriorated.

Suitable examples of homopolymers which can be used as the polymer (B) include polybutylmethacrylate (Tg: 18° C.), polymethylacrylate (Tg: 8° C.), polyethylacrylate (Tg: −24° C.), polybutylacrylate (Tg: −55° C.), poly-2-ethylhexylacrylate (Tg: −70° C.) and so on. Preferred examples of plural copolymers include methylmethacrylate/ethylmethacrylate/2-ethylhexylacrylate (27/37/36 by molar ratio) ternary copolymer (Tg: 18° C.), methylmethacrylate/methylacrylate/ethylacrylate (30/40/30) ternary copolymer (Tg: −8° C.), styrene/methylacrylate/butylacrylate (20/10/70) ternary copolymer (Tg: −32° C.), and so on.

Preferred colloidal substance selected from colloidal silica and alumina to be employed in this invention are those having an average grain size of from $5\times10^{-5}$ to $1\times10^{-7}$ cm, and when used in a form of dispersion in a dispersing solvent like methanol upon preparation of a coating composition for the interlayer, it can most desirably exhibit its effects. Further, when colloidal substance selected from colloidal silica and alumina is used in an amount of from 30 to 300 parts by weight based on solid component per 100 parts by weight (on the basis of solid component) of the above-described organic solvent-soluble resin, it has effects on enhancement of adhesiveness and decrease in stain in the non-image area (which is described hereinafter as background stain). If colloidal silica and/or alumina is incorporated in an amount less than 30 parts by weight, the resulting adhesion power is weak, and generation of background stain also occurs, whereas if more than 300 parts by weight is incorporated, though adhesiveness and background stain are improved, the resin interlayer formed through coating and drying steps becomes fragile and tends to crack, and further the maximum surface potential attainable by charging is lowered to cause a decrease in the amount of toner that can adhere thereto. A particularly desirable amount of colloidal silica and/or alumina to be incorporated is from 50 to 200 parts by weight.

An effective coverage of the interlayer of this invention ranges from 1.5 to 10.0 g/m$^2$, particularly preferably from 3.0 to 6.0 g/m$^2$. If the coverage is less than 1.5 g/m$^2$, white spots tend to be generated in the image area, whereas if it is more than 10.0 g/m$^2$, generation of background stain occurs.

Suitable examples of photoconductive substances which can be employed in the photoreceptive layer of this invention include inorganic substances such as cadmium sulfide, zinc oxide, zinc sulfide, etc., and organic substances such as azo pigments such as Sudan Red, Dian Blue, etc., quinone pigments such as pyrene quinone, Algol Yellow, etc., indigo pigments, phthalocyanine pigments, and so on. Examples of binders for the above-described photoconductive pigments include polyurethane resins, malamine resins, silicone resins, alkyd resins, epoxy resins, homo- or copolymer resins comprising of acrylates or/and methacrylates, polyesters, polyamides, epoxy resins, styrene-butadiene copolymers, polyethylene, polystyrene, and mixtures composed of two or more thereof. Besides these components, the photoreceptive layer can contain a sensitizing dye, e.g., Rose Bengal, Auramine, Bromophenol Blue, Fluoresceine, or so on. The optimum photoconductive substance which can be generally used in electrophotography utilizing lithographic printing material is zinc oxide from the viewpoints of price, pollution problem, capability, and so on, as is described in a large number of patents and articles in the technical literature. Ordinary dry coverage of the above-described photoreceptive layer is in the range of from 15 to 35 g/m$^2$ in case of an inorganic layer, and in the range of from 1 to 10 g/m$^2$ in case of organic layer.

A conventional method can be used when a lithographic printing plate is prepared from the electrophotographic photoreceptor of the invention. The method comprises uniformly charging the photoconductive layer of an electrophotographic photoreceptor, subjecting the charged photoreceptor to imagewise exposure, developing the image by either a wet or dry method to provide a toner image, fixing the toner image and treating the photoconductive layer with a desensitizing solution (etching solution) to render the nonimage area (without a toner image) hydrophilic to thereby produce a lithographic printing plate. Suitable toner for this purpose is described in U.S. Pat. No. 3,107,169, and suitable desensitizing solution appears in U.S. Pat. Nos. 3,001,872; 3,592,640; and 4,208,212.

The present invention is illustrated in greater detail by reference to the following examples.

EXAMPLE 1

In a stream of nitrogen, 300 g of dioxane was heated up to 100° C. and thereto, a mixture consisting of 150 g of 2-hydroxyethylmethacrylate, 60 g of acrylonitrile, 79.5 g of methylmethacrylate, 10.5 g of methacrylic acid, and 1.2 g of benzoyl peroxide was added dropwise over a 2-hour period. After 15 minutes from the conclusion of the dropwise addition, 300 g of dioxane and 0.3 g of benzoyl peroxide were further added to the reaction mixture, and reaction was resumed for 4 hours. At the conclusion of the reaction, a copolymer was precipitated by diluting the product with methanol and then pouring it into water, and the polymer was then dried at 70° C. under vacuum. The acid value of the thus obtained 2-hydroxyethylmethacrylate copolymer (I) was 20, and this copolymer was employed as the component (A) of the organic solvent-soluble resin.

On wood-free paper having a basis weight of 100 g/m$^2$, a 5% water solution of polyvinylbenzyltrimethylammonium chloride was coated at a coverage of 2 to 3 g/m$^2$, and dried to prepare conductivity-imparted paper. On both sides of the thus converted paper, an aqueous latex of the ethylene/methylacrylate/acrylic acid copolymer (65/30/5 by weight) was coated in such an amount that the dry coverage of the copolymer would be 0.2 g/m$^2$, and dried. Thereafter, lamination was further carried out on both sides of the thus coated paper using a pellet prepared by kneading 85% of polyethylene (density 0.92, mean molecular weight 22,000, softening point 112° C.) and 15% of conductive carbon in a molten condition (Melt Index: 3) according to an extrusion process. Herein, a thickness of the laminate per one side was controlled to 25 μm. Thus, a conductive support was prepared. Next, the surface of the polyethylene laminate layer on one side of the support was subjected to a corona discharge treatment under the condition of 5 KVA·sec/m$^2$ and thereon, a coating solution having the following composition was coated at a dry coverage of 4.5 g/m$^2$ using a wire bar technique, and dried. Thus, an interlayer was provided.

| Component | Parts By Weight |
|---|---|
| 2-Hydroxyethylmethacrylate Copolymer (Component A) | 8 |
| Methylmethacrylate/ethylmethacrylate/2-ethylhexylacrylate Copolymer (Molar Ratio = 27/37/36) (Component (B)) | 2 |
| Methanol.Silica Sol (Methanol: 30 wt %, produced by Nissan Chemicals Industries, Ltd.) | 28 |
| Methylene Glycol | 30 |
| Methyl Ethyl Ketone | 18 |
| Methyl Cellosolve Acetate | 42 |

A grain size of silica in the methanol.silica sol was measured using a size distribution measuring instrument, Nano-Sizer (Britain: Coulter Electronics Company), and the center of the size distribution of the silica was 0.18 μm.

On this interlayer, a coating solution having the following composition was coated at a dry coverage of 20 g/m$^2$, and dried to prepare a photoconductive layer. Thus, an electrophotography utilizing lithographic printing material was obtained.

| Component | Parts By Weight |
|---|---|
| Photoconductive Zinc Oxide (Sazex 2000, produced by Sakai Chemical Industry Co., Ltd.) | 100 |
| Daiyanal LR018 (acrylic resin produced by Mitsubishi Rayon Company Limited) | 35 |
| Rose Bengal | 0.1 |
| Fluoresceine | 0.2 |
| Methanol | 10 |
| Toluene | 150 |

A printing plate was made using the thus obtained lithographic printing material and a process machine, ELP 280 (produced by Fuji Photo Film Co., Ltd.). The resulting plate was desensitized with an etching solution, ELP (produced by Fuji Photo Film Co., Ltd.). Then, printing was carried out using an offset press, and at most 25,000 sheets of printed matter of good quality was obtained.

EXAMPLE 2

Another 2-hydroxyethylmethacrylate copolymer (II) was synthesized in the same manner as in Example 1. A composition of the 2-hydroxyethylmethacrylate copolymer (II) was 2-hydroxyethylmethacrylate/acrylonitrile/methylmethacrylate/methacrylic acid=60/10/27.5/2.5 by wt%. This copolymer was used as the component (A) of the organic solvent-soluble resin and polybutylmethacrylate (Tg: 18° C.) was used as the component (B). Under these conditions, an electrophotography utilizing lithographic printing material was produced and printing was carried out in the same manner as in Example 1. Thus, at most 20,000 sheets of printed matter of good quality were obtained.

EXAMPLE 3

Of the components for forming the resin interlayer employed in Example 1, the methanol.silica sol was replaced by alumina sol, and a coating composition for an interlayer was prepared according to the following formula:

| Component | Parts By Weight |
|---|---|
| 2-Hydroxyethylmethacrylate Copolymer | 9 |
| Polymethylacrylate (Tg: 8° C.) | 1 |
| Alumina Sol 200 (Water: 10 wt %, produced by Nissan Chemicals Industries Ltd.) | 80 |
| Methylene Glycol | 30 |
| Methyl Ethyl Ketone | 18 |
| Methyl Cellosolve Acetate | 42 |

The thus prepared coating composition was coated on the same kind of conductive support as in Example 1. On the resulting interlayer, a photoreceptive layer was also provided in the same manner as in Example 1, to produce an electrophotography utilizing lithographic printing material. Plate-making and printing were carried out in the same manner as in Example 1, and 20,000 sheets of printed matter of good quality were obtained.

COMPARATIVE EXAMPLES 1–3

The same procedure of Example 1 was repeated except that the interlayer was not used (Comparative Example 1), that the methanol.silicasol was not contained in the interlayer (Comparative Example 2) and that the methanol.silicasol was replaced by a mixture of 28 parts by weight of methanol.silicasol and 10 parts by weight of polyvinylacetate (mean molecular weight: 80,000) (Comparative Example 3).

The results of Examples 1 to 3 and Comparative Examples 1 to 3 are tabulated below.

TABLE

| | White Spots | Density of Fog | Background Stains | Press life (Number of Sheets) |
|---|---|---|---|---|
| Example 1 | o | 0.09 | o | 25,000 |
| Example 2 | o | 0.09 | o | 20,000 |
| Example 3 | o | 0.10 | o | 20,000 |
| Comparative Example 1 | x | 0.08 | o | 1,000 |
| Comparative Example 2 | o | 0.13 | Δ | 20,000 |
| Comparative Example 3 | o | 0.14 | Δ | 10,000 |

In the above Table
o represents that white spots or stains appeared.
Δ represents that stains appeared slightly.
x represents that many white spots appeared.

Thus, it would be apparent from the above results that the electrophotographic photoreceptor of the present invention exerts superior properties in generation of white spots in the image area, background stains produced on printing, press life and density of fog.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor in which an interlayer and a photoconductive photoreceptive layer are provided on a conductive support in that order, said interlayer comprising at least one colloidal substance selected from the group consisting of colloidal silica and colloidal alumina, and an organic solvent soluble resin which is composed of:

(A) a polymer having an acid value of from 10 to 100 and containing repeating units represented by formula (I) in the range of 30 to 80 wt.% and formula (II) in the range of 5 to 60 wt.%, based on the total weight of the polymer A:

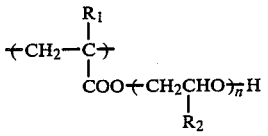

(I)

wherein $R_1$ is H or $CH_3$; $R_2$ is H, $-CH_3$, $-C_2H_5$, or a chloromethyl group; and n is an integer of 1 to 10; and

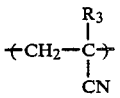

(II)

wherein $R_3$ is H or $-CH_3$; and (B) 5 to 30 parts by weight per 100 parts by weight of polymer (A) of at least one polymer selected from the group consisting of a homopolymer and plural copolymer having a glass transition point (Tg) of from −70 ° to 20° C.;

said colloidal substance being used in an amount of 30 to 300 parts by weight based on solid component per 100 parts by weight on the basis of solid component of said organic solvent-soluble resin; and said interlayer being provided in a coverage of 1.5 to 10.0 g/m$^2$.

2. An electrophotographic photoreceptor as in claim 1, wherein said conductive support is a sheet of paper which contains an electrically conductive substance and has laminated to at least one side thereof a polyethylene layer having a thickness of from 5 to 50 μm and containing carbon black in a concentration of from 5 to 30% by weight.

3. An electrophotographic photoreceptor as in claim 1, wherein the polymer (A) has an acid value of from 15 to 40.

4. An electrophotographic photoreceptor as in claim 1, wherein the organic solvent-soluble resin comprises from 10 to 40 wt% the repeating unit represented by formula (II), from 40 to 60 wt% the repeating unit represented by formula (I), and from 5 to 30 parts by weight of polymer (B) per 100 parts by weight of polymer (A).

5. An electrophotographic photoreceptor as in claim 1, wherein the colloid substance has an average grain size of from $5\times10^{-5}$ to $1\times10^{-7}$ cm.

6. An electrophotographic photoreceptor as in claim 2, wherein the colloid substance has an average grain size of from $5\times10^{-5}$ to $1\times10^{-7}$ cm.

7. An electrophotographic photoreceptor as in claim 1, wherein the interlayer is provided in a coverage of from 3.0 to 6.0 g/m$^2$.

8. An electrophotographic photoreceptor as in claim 1, wherein the photoreceptive layer comprises a photoconductive material and a binder.

9. An electrophotographic photoreceptor as in claim 8, wherein the photoconductive material is zinc oxide.

* * * * *

UNITED STATES PATENT AND TRADEMARK OFFICE

CERTIFICATE OF CORRECTION

PATENT NO. : 4,559,288

DATED : December 17, 1985

INVENTOR(S) : Sho NAKAO, et al

It is certified that error appears in the above-identified patent and that said Letters Patent is hereby corrected as shown below:

On the title page

Column 1 at [73] insert --and Tomoegawa Paper Co., Ltd., Tokyo, Japan--

Signed and Sealed this

*Eighth* Day of *July 1986*

[SEAL]

*Attest:*

DONALD J. QUIGG

*Attesting Officer*

*Commissioner of Patents and Trademarks*